United States Patent [19]

Baus

[11] Patent Number: 4,558,526

[45] Date of Patent: Dec. 17, 1985

[54] ARRANGEMENT WITH A FAN

[76] Inventor: Heinz G. Baus, 35, Wartbodenstrasse, CH-3626 Hünibach/Thun, Switzerland

[21] Appl. No.: 578,114

[22] Filed: Feb. 8, 1984

[30] Foreign Application Priority Data

Feb. 10, 1983 [DE] Fed. Rep. of Germany ..... 3304559

[51] Int. Cl.[4] ..... F26B 19/00

[52] U.S. Cl. ..... 34/232; 34/233; 34/343 R; 98/40.01; 98/40.18; 98/41.3; 137/630.17; 251/345

[58] Field of Search ..... 34/232, 243 R, 233; 98/31, 33 A, 39, 40 R, 40 A, 40 C, 40 H, 41 SV, 116; 251/345, 352; 137/314, 630.17

[56] References Cited

U.S. PATENT DOCUMENTS

| | | | |
|---|---|---|---|
| 842,538 | 1/1907 | Elward | 34/232 X |
| 1,336,970 | 4/1920 | LaRue | 137/314 |
| 2,825,979 | 3/1958 | Verwayen et al. | 98/40 H X |
| 3,128,161 | 4/1964 | Hudon | 34/233 |
| 3,299,529 | 1/1967 | Roberts et al. | 34/232 X |
| 3,659,515 | 5/1972 | Galaniuk | 98/40 C X |
| 3,878,621 | 4/1975 | Duerre | 34/233 X |
| 4,006,672 | 2/1977 | Matsuyoshi et al. | 98/116 X |
| 4,370,155 | 1/1983 | Armbruster | 98/33 A X |

FOREIGN PATENT DOCUMENTS

| | | | |
|---|---|---|---|
| 7538272 | 9/1977 | Fed. Rep. of Germany . | |
| 760545 | 10/1956 | United Kingdom | 98/31 |

*Primary Examiner*—Harold Joyce

*Attorney, Agent, or Firm*—Schwartz, Jeffery, Schwaab, Mack, Blumenthal & Evans

[57] ABSTRACT

The invention relates to an arrangement with a fan (12) for producing an air stream which can be heated by means of a heating element (14), with a housing (2) which has one or more air outlet openings (4) along its longitudinal axis, and with a control member (16), the openings (18) of which are associated with the air outlet openings (4) to regulate the air stream. So that such a device can be utilized in wet spaces, showerbath cubicles or the like and so that furthermore drying of the body is possible after a shower or bath, it is proposed according to the invention that the openings (18) of the control member (16) are arranged at a predetermined angle with respect to the longitudinal axis (6). Depending on the position of the control member (16), the air stream emerges from the air outlet openings (4) with substantially constant strength in a preselectable region along the longitudinal axis.

16 Claims, 2 Drawing Figures

ARRANGEMENT WITH A FAN

The invention relates to an arrangement with a fan for producing an air stream which can be heated by means of a heating element, with a housing which has along its longitudinal axis one or more air outlet openings, and with a control member, the openings of which are associated with the air outlet openings to regulate the air stream.

In German Utility Model No. 75 38,272 an arrangement is known for an air conditioning plant which has a cylindrical housing provided with air outlet openings. These air outlet openings are arranged one behind the other in the direction of the longitudinal axis and can be covered by a shutter, which if necessary can consist of several parts. Depending on the setting of the shutter, the angle of opening is preset, so that the speed, direction, form of stream, and amount of air can be varied. Since the known arrangement is used in connection with an air conditioning plant, a sufficiently high air input pressure will always be present. If all the openings of the shutter are opened, a sufficiently strong air stream will always still be able to emerge through the air outlet openings. Separate installation of the arrangement, i.e., without the air conditioning plant, is not contemplated. It should be noted that in known air conditioning plants, an excessively strong air stream is fundamentally avoided, since it is very easily found to be unpleasant and is also disadvantageous on health grounds.

Furthermore, electrical heating devices are known for heating the air, which have a fan and an electrical heating element. If desired, a cold air stream can also be emitted with the heating element switched off. Such devices are transportable and can be used throughout the whole dwelling space. Use in a wet space, in particular in a showerbath, must however be avoided for safety reasons. Furthermore, with a device of this type no reliable drying of the body of a user after a shower or bath can be undertaken, in particular because only a relatively small region of the body is included in the hot air stream.

The object of the invention is to propose an arrangement in which the heated air stream can emerge in preselectable regions with reference to a longitudinal axis. The arrangement should have a simple construction and be suitable for use in wet spaces, shower cubicles, or the like. Furthermore, drying of the body after a shower or bath is to be made possible and/or a "hot air showerbath" is to be provided. In addition to this, the arrangement is to be produced at low cost and have a high degree of safety and reliability in operation. In particular, in relation to the production costs, the fan and also the heating element are to be designed for comparatively small power; a heating power on the order of magnitude of a few thousand watts is not to be exceeded. In particular, in relation to fan noise and structural volume, the fan should also be kept as small as possible. A sufficiently strong air stream for drying is however to be ensured. Finally, the arrangement is to be adaptable to the conditions of use and adequate to meet operating requirements.

This object is achieved according to the invention in that the openings of the control member are arranged at a predetermined angle with respect to the longitudinal axis, and in that depending on the position of the control member the air stream emerges in a preselectable region along the longitudinal axis with substantially constant force.

The arrangement according to the invention makes it possible at a small constructional cost for the air stream to be blown out in the respectively desired regions along the longitudinal axis of the housing. In particular, if the longitudinal axis is arranged vertically, the heated air stream can be blown onto the feet, arms, or head of a user as desired, in order to obtain the desired drying, or else the device can be used as a warm air showerbath. With the heating element switched off, the arrangement can be used, for example in summer, as a "cold air showerbath" for cooling.

The arrangement according to the invention can readily be used in wet spaces without special safety problems arising, and in particular the fan and heating element can be arranged without difficulty outside the wet region or shower cubicle, in which case the connection to the housing can be produced by means of a suitable flow channel. It should be mentioned that according to the invention the longitudinal axis is advantageously arranged vertically, but within the scope of the invention the longitudinal axis can also assume another orientation, for example, in order to conduct the hot air stream as desired to a person lying down. Furthermore, within the scope of the invention the housing and also the longitudinal axis can be arranged to be pivotable into the position desired at any given time. Basically, a single outlet opening extending in the longitudinal direction on the housing is sufficient, but it is advantageous to provide a number of smaller openings, slots, or the like, which are separated from each other by webs. A sufficient strength of the housing is thus achieved and also the penetration of foreign bodies into the housing is substantially avoided in a simple manner. The same correspondingly holds for the control member so that by a suitable construction and arrangement of its openings and their adjustability, the air stream emerges at the desired locations at any given time.

In one advantageous embodiment, the control member is arranged within the housing, and abuts the inner surface of the housing, at least in the vicinity of the air outlet opening. This ensures in a simple manner that the air stream can also actually emerge from the housing in the desired region. The mutually adjacent surfaces of the control member and the housing can, insofar as the control member executes translational motions, be made planar or else, for rotational motions, be made coaxial and/or curved.

In a significant embodiment, the control member is movable transversely of the longitudinal axis, whereby the opening or openings are arranged at a prescribed angle with respect to the longitudinal axis. If only a single opening is present, it is formed as an inclined or spiral-shaped slot.

With many openings, the openings are advantageously arranged offset in a cascade formation with respect to the longitudinal axis. It should be expressly remarked at this point that within the scope of the invention the outlet openings and also the openings in the control member are formed and arranged such that, regardless of the position of the control member at any given time, a predetermined minimum air stream can emerge.

In a particularly significant embodiment, the control member is constructed as a hollow body which is connected to the outlet channel of the fan. Basically the fan together with the heating element can be arranged directly at one end of the control member, and in fact, in a vertical arrangement, advantageously at the upper end. The other end of the hollow body is closed in a suitable manner, so that the air stream can emerge in the desired manner through the openings located on the cylindrical outer surface. In such an embodiment of the invention, the housing does not need to be closed in any way, instead there only needs to be a sufficiently tight or close abutment between the control member and the housing in the region of the outlet opening and also of the openings of the control member.

In a particularly advantageous embodiment the control member is constructed as a substantially cylindrical tube which is rotatable about its longitudinal axis and which has openings on its cylindrical surface. Such a control member can be manufactured without difficulty from commercially available material, in particular in the form of a synthetic resin tube. The required openings can also be made very easily in the cylindrical surface. The internal surface of the housing as viewed in the circumferential direction is likewise cylindrical, at least in the region of the outlet openings, and coaxial with the control member. It can be seen that a reliable and sufficient seal is thus ensured to prevent undesirable bypass flows.

In an important embodiment the housing is constructed as a preferably cylindrical tube in which the control member is rotatably arranged. The control member abuts the cylindrical inner surface of the tubular housing at least in the region of the outlet opening. The control member can be constructed, in a first embodiment, as a sector element which is rotatable within the housing. In this case according to the invention, the housing is closed at one end by means of a bottom or the like, while at the other end the connection to the fan is established, in particular via an air channel. In another significant embodiment, on the other hand, the control member is constructed as a cylindrical tube so that the housing and control member can also be referred to as telescopic tubes. The tubular control member in this case has as small as possible a spacing from the inner surface of the housing such that on the one hand easy rotatability is ensured and on the other hand leakage air streams are substantially prevented.

The control member and/or the housing, constructed as a hollow body or tube, advantageously has at its lower end a small drain opening in the bottom. Water which possibly may enter the hollow body can simply flow out through this drain opening.

In a particularly significant embodiment, the housing and/or control member is connected via an air channel to the fan and also to the heating element. The fan and heating element can thus be disposed at a distance from the housing so that a separation, exactly as is requisite in wet spaces, is achieved. The electrical leads for the heating element and the fan can then have the necessary safety spacing, so that, for example, no water can reach there from a shower bath. Costly safety devices for the fan and heating element can be omitted, thereby achieving cost savings which are not inconsiderable.

The air channel can be readily constructed as a flexible hose, connecting bellows, or the like, so that no particular difficulties arise during construction of the assembly.

In a particularly advantageous embodiment, in which the air outlet openings can also be completely covered by means of the control member, a preferably water tight switch is provided by means of which, in the aforesaid position, the fan and/or the heating element can be switched off. The aforesaid closed configuration is is advantageous insofar as the penetration of water or dirt is prevented when the device is not in use. However, so that in this position no overheating can occur due to a switched-on fan and also heating element, the latter is reliably switched off by means of the water tight switch.

Additional features and advantageous embodiments of the invention will be apparent from the following working examples, explained in detail with reference to the drawing, in which.

Figure 1:
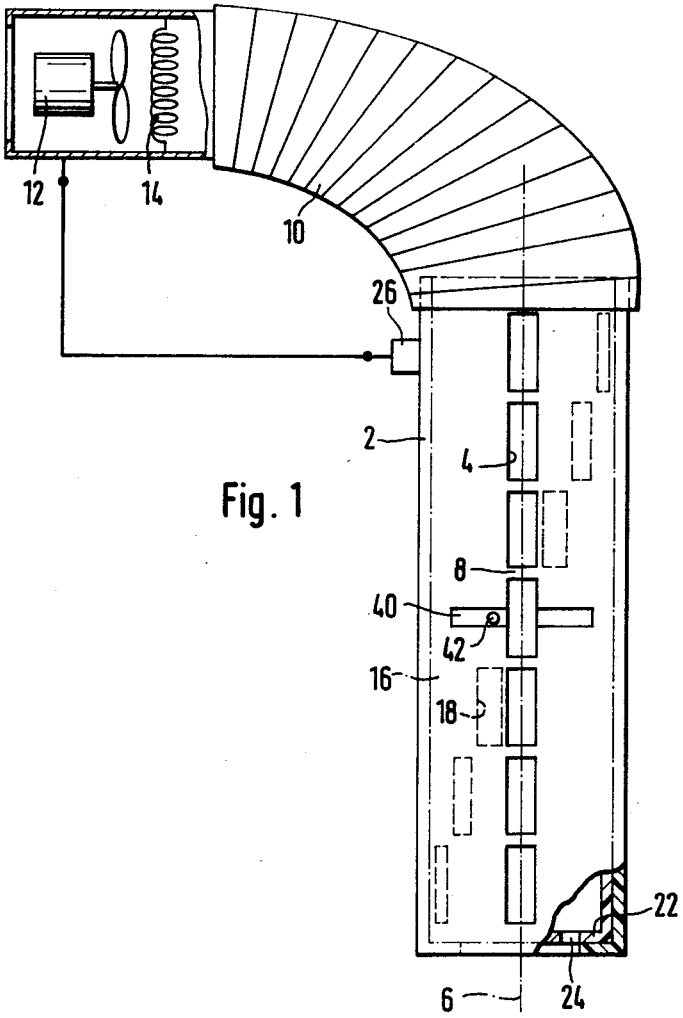
FIG. 1 shows a schematic view of an arrangement in which the housing and the fan are connected together via an air channel.

The view according to FIG. 1 shows a housing 2, which is constructed as a cylindrical tube and has on its outer surface a number of air outlet openings 4. These air outlet openings 4 are arranged close to each other in the direction of the longitudinal axis 6 with narrow webs 8 between the individual openings. Within the scope of the invention a single air outlet opening 4, extending practically over the whole length of the housing 2, could also be provided, but the illustrated embodiment is preferred for strength reasons.

An air channel 10, which is constructed as a connecting bellows and and forms the connection to a fan 12 and an electrical heating element 14, opens into the upper end of the housing 2. Within the scope of the invention, the fan 12 and the heating element 14 can also be arranged directly on this housing, and advantageously at its upper end, without interposition of an air channel. The spatially separated arrangement shown is recommended for cases in which the housing is to be arranged in a wet region, in particular within a shower cubicle.

Within the housing 2 is located a control member 16, indicated by broken lines and having openings 18 on its outer surface. These openings 18 are arranged in a cascade formation one above the other. Alternatively, a single slot, inclined with respect to the longitudinal axis, or a slot spirally arranged on the control member 16, could also be provided. For the reasons mentioned above, however, a number of such openings 18 are also advantageously provided on the control member 16. The control member 16 is formed in this case as a hollow body and in particular as a cylindrical tube, on the outer surface of which the openings 18 are arranged. The air channel 10 opens from above into the control member 16. The control member 16 is closed at the lower end by means of a bottom 22. The bottom 22 contains a drain opening 24, through which any water or the like penetrating into the control member can flow downwards. The control member 16 abuts on a ring 20 at the bottom of the housing 2. Alternatively, a closed bottom, supporting webs, or the like could be provided instead of the ring. The control member 16 is rotatable about the longitudinal axis 6. It can be seen that, depending on the respective position of the control member 16, the air stream can flow out of the housing 2 at the desired position along the longitudinal axis 6. It requires no particular emphasis that the respective open outlet cross section, the fan power, and the cross section of the air channel 10 are matched to each other so that a sufficiently strong air stream emerges. The housing 2 contains, about in the middle, a transverse slot 40, through which a lever 42 connected to the control member 16 projects so that rotation of the control member 16 is made possible.

The openings 18 extend downwardly from the top over a predetermined angular region of the cylindrical surface of the control member 16. If desired, the openings 18 can also be arranged such that in one rotary position all the air outlet openings 4 of the housing 2 are closed by means of the control member 16. So that no overheating can occur in this position, a switch element 26 is also advantageously provided between the housing 2 and the control member 16, to switch off the fan and also the heating element. The desired switching on and off of the fan 12 and heating element 14 can also be carried out without difficulty by means of the switch element 26. Depending on the rotary position of the control member, the fan 12 and or the heating element 14 are switched on or off by means of the swtich element 26. Operation is hereby not insubstantially facilitated and also safety is hereby substantially improved, since a user has only to actuate the control member and does not have to directly contact any electrical switch. Since, within the scope of this invention, the housing and the control member are made of plastic, faultless electrical insulation is ensured. If necessary, the switch element can also be designed for low voltage from a small transformer connected before it. The operating voltage can then be applied to the fan 12 and the heating element 14 via a further relay.

Figure 2:
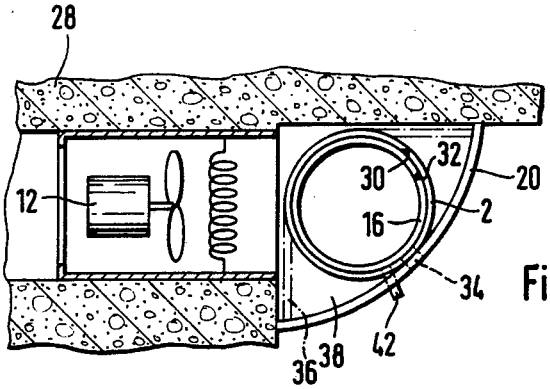
FIG. 2 shows a view of an arrangement corresponding to FIG. 1 disposed in a shower cubicle.

FIG. 2 shows a view of an arrangement which is built into the corner of a showerbath cubicle or the like and with which a cover 20 is associated. The cover 20 extends through the angular region of 90 degrees in the corner between the two room walls 28, a suitable connection to the room walls 28 being provided by screws, pins, or the like. The air channel 10 described above is not shown here for reasons of clarity. There can be seen the cylindrical and coaxially arranged housing 2 and control member 16 which may also be referred to as telescopic tubes because of the arrangement according to the invention. It is evident that no special mountings and guide surfaces or the like are required for the control member, since the outer surface 30 lies adjacent the inner surface of the housing 2 with only a comparatively small space (between them). The housing 2 can be connected to the room wall 28 either directly or else via the cover 20. The cover 20 has a further outlet opening 34 coinciding with the outlet opening 4 of the housing 2. Matching to the surroundings can be carried out in a simple manner by means of the cover 20, by suitably forming the outer surface of the cover, for example, coloration corresponding to the sanitary color of the tiling of the room walls and/or by corresponding shaping.

In the embodiment according to FIG. 2, the cover 20 and housing 2 are constructed as separate components. However, these can also be integral within the scope of the invention. It should be expressly emphasized that within the scope of the invention the housing can also be constructed as only a sector part similar to the cover 20. In such an embodiment, the control member 16 then has its outer surface adjacent to the internal surface of the sector-shaped housing throughout a predetermined angular region. Because of their mutually abutting positions, a bypass air flow is prevented in all angular positions of the control member relative to the housing. An embodiment is shown in FIG. 2 by dashed lines with the housing and cover integrated into each other, in which case the intermediate regions can be omitted if desired.

I claim:

1. A forced air flow device comprising: an elongated air flow duct having a longitudinal axis and formed with an outlet opening arrangement comprising at least one air outlet opening through the wall thereof, said outlet arrangement extending parallel to said longitudinal axis; means blowing air into said duct for discharge through said outlet opening arrangement; a control member mounted against said wall of said duct adjacent said air outlet arrangement for controlling egress of air through said outlet opening arrangement, said control member being formed with at least one control opening disposed in an arrangement extending at an angle longitudinally and transversely across said air outlet opening arrangement, the longitudinal position along said outlet arrangement at which the control opening arrangement crosses depending on the position of said control member; and means for causing relative displacement of said control member to cause a portion of said control opening arrangement to register with a selected portion of said outlet opening arrangement, the cross-sectional area of the registering portion of said outlet opening arrangement and said control opening arrangement being substantialy the same size for all open postiions of the control member whereby to allow egress of air at selected locations along said duct depending on the position of the control member and at essentially constant strength.

2. A device as claimed in claim 1, wherein said outlet opening arrangement comprises a plurality of spaced air outlet openings linearly distributed along said duct wall.

3. A device as claimed in claim 2, wherein said control opening arrangement comprises a plurality of spaced and aligned control openings distributed in cascade formation along said control member, said cascade formation being arranged to cross the line of said air outlet openings at a selected location depending on the position of the control member.

4. A device as claimed in claim 1, wherein said control member lies within said air flow duct, flat against the inner surface thereof.

5. A device as claimed in claim 1, wherein said control member lies within said air flow duct, flat against the inner surface thereof, and said air flow duct is stationary and said control member is movable within said duct.

6. A device as claimed in claim 1, wherein said air flow duct and said control member are cylindrical bodies, said displacement means rotatably displacing said control member with respect to said air flow duct.

7. A device as claimed in claim 1, wherein said air flow duct and said control member are cylindrical bodies, said displacement means rotatably displacing said control member with respect to said air flow duct; and said air blowing means comprising a fan and air channel means interconnecting said fan and said air flow duct at one end thereof to blow air thereinto.

8. A device as claimed in claim 1, wherein said air flow duct and said control member are coaxial cylindrical bodies, said displacement means rotatably displacing said control member with respect to said air flow duct.

9. A device as claimed in claim 1, wherein said air flow duct and said control member are cylindrical bodies, said displacement means rotatably displacing said control member with respect to said air flow duct; and said air blowing means comprising a fan and air channel means interconnecting said fan and said cylindrical control member at one end thereof to blow air into said control member.

10. A device as claimed in claim 1, wherein said air flow duct and said control member are cylindrical bodies, said displacement means rotatably displacing said control member with respect to said air flow duct; said air blowing means comprising a fan and air channel means interconnecting said fan and said cylindrical control member at one end thereof to blow air into said control member; said air flow duct having a peripheral ledge at the end thereof remote from said air blowing means; and said cylindrical control member sitting on said ledge, being closed at the other end thereof and being formed at said other end with a small drain hole.

11. A device as claimed in claim 1, wherein said air flow duct and said control member are cylindrical bodies, said displacement means rotatably displacing said control member with respect to said air flow duct; said air blowing means comprising a fan and air channel means interconnecting said fan and said air flow duct at one end thereof to blow air thereinto, and said air channel means comprising a bellows section.

12. A device as claimed in claim 1, wherein said air flow duct and said control member are cylindrical bodies, said displacement means rotatably displacing said control member with respect to said air flow duct, said air flow duct having a movement control slot extending through and transversely of the wall thereof with respect to said longitudinal axis, and said displacement means comprising an operating lever on said control member, extending through said slot; said device further comprising electric switch means operatively connecting said control member and said air blowing means to shut off said air blowing means when said air outlet openings are closed.

13. A device as claimed in claim 1, for use in combination with a room having a corner formed of two angularly intersecting walls; further comprising a cover having lateral edges fixed to said walls to delimit therewith a casing for said device, said cover having an air outlet opening corresponding in size to said air flow duct outlet opening, and wherein said air flow duct is mounted behind said cover with said openings of said duct and of said cover in registry.

14. A device as claimed in claim 1, wherein said control member is provided with a plurality of openings disposed in a helical arrangement with respect to the longitudinal axis of said air flow duct.

15. A device as claimed in claim 1, wherein said air flow duct is vertically oriented.

16. A device as claimed in claim 9, wherein said fan is disposed above said air flow duct and control member.

* * * * *